US009610465B2

(12) United States Patent
Stuck et al.

(10) Patent No.: US 9,610,465 B2
(45) Date of Patent: Apr. 4, 2017

(54) FIRE SUPPRESSION MODULE, MODULAR SYSTEM INCLUDING SAME, AND METHOD OF INSTALLING MODULAR SYSTEM

(71) Applicant: Hutchinson, S.A., Paris (FR)

(72) Inventors: Larry W. Stuck, Amherst, NY (US); Mark Allen Glasgow, Jr., Lewiston, NY (US); Colin Gehris Vogel, Cheektowaga, NY (US); Florence Ratet, Parmain (FR); Eric Forster, Nerville la Foret (FR)

(73) Assignee: HUTCHINSON, S.A., Paris (FR)

( * ) Notice: Subject to any disclaimer, the term of this patent is extended or adjusted under 35 U.S.C. 154(b) by 383 days.

(21) Appl. No.: 14/056,435

(22) Filed: Oct. 17, 2013

(65) Prior Publication Data

US 2014/0102734 A1 Apr. 17, 2014

Related U.S. Application Data

(60) Provisional application No. 61/714,976, filed on Oct. 17, 2012.

(51) Int. Cl.

| | |
|---|---|
| ***A62C 3/06*** | (2006.01) |
| ***A62C 3/07*** | (2006.01) |
| ***A62C 35/10*** | (2006.01) |
| ***A62C 99/00*** | (2010.01) |

(52) U.S. Cl.

CPC ..... *A62C 3/07* (2013.01); *A62C 3/065* (2013.01); *A62C 35/10* (2013.01); *A62C 99/0045* (2013.01); *Y10T 29/49826* (2015.01)

(58) Field of Classification Search

CPC .. A62C 3/06; A62C 3/065; A62C 3/07; A62C 99/0045; B65B 90/22

USPC ..... 169/30, 34–36, 48, 49, 51, 54, 62, 66; 220/88.1

See application file for complete search history.

(56) References Cited

U.S. PATENT DOCUMENTS

| | | | | |
|---|---|---|---|---|
| 926,998 | A * | 7/1909 | McLaughlin | A62C 5/002 169/34 |
| 2,911,049 | A | 11/1959 | Crouch | |
| 5,053,146 | A * | 10/1991 | Yamaguchi | A62D 1/0014 169/44 |
| 5,170,933 | A | 12/1992 | Perry | |
| 5,674,586 | A | 10/1997 | Toni et al. | |
| 7,896,121 | B2 | 3/2011 | Thompson et al. | |

(Continued)

FOREIGN PATENT DOCUMENTS

| | | |
|---|---|---|
| GB | 2 302 849 A | 2/1997 |
| JP | H 10201871 A | 8/1998 |

(Continued)

OTHER PUBLICATIONS

International Preliminary Report on Patentability for corresponding International Application No. PCT/US2013/065432, dated Apr. 21, 2015.

(Continued)

*Primary Examiner* — Darren W Gorman
(74) *Attorney, Agent, or Firm* — K&L Gates LLP

(57) ABSTRACT

A fire suppression module. The fire suppression module includes a base member, a cap member and a fire suppressant. The cap member is connected to the base member. The base member and the cap member cooperate to form a an enclosure. The fire suppressant is positioned within the enclosure.

8 Claims, 7 Drawing Sheets

(56) References Cited

U.S. PATENT DOCUMENTS

| | | | | |
|---|---|---|---|---|
| 7,905,296 | B2 | 3/2011 | Bennett | |
| 2007/0215363 | A1 | 9/2007 | McKim et al. | |
| 2009/0018382 | A1 | 1/2009 | Eckholm et al. | |
| 2010/0025054 | A1 * | 2/2010 | Jesclard | A62C 8/06 169/67 |
| 2010/0276165 | A1 | 11/2010 | Hobson et al. | |
| 2011/0297402 | A1 | 12/2011 | Belmonte et al. | |

FOREIGN PATENT DOCUMENTS

| | | | |
|---|---|---|---|
| WO | WO 2008/009148 | A1 | 1/2008 |
| WO | WO 2011/153651 | A1 | 12/2011 |

OTHER PUBLICATIONS

International Search Report and Written Opinion for corresponding International Application No. PCT/US2013/065432, dated Mar. 13, 2014.

* cited by examiner

FIRE SUPPRESSION MODULE, MODULAR SYSTEM INCLUDING SAME, AND METHOD OF INSTALLING MODULAR SYSTEM

CROSS-REFERENCE TO RELATED APPLICATION

This application claims the benefit under 35 U.S.C. §119 (e) of the earlier filing date of U.S. Provisional Patent Application No. 61/714,976 filed on Oct. 17, 2012.

BACKGROUND

This application discloses an invention which is related, generally and in various embodiments, to a fire suppression module, a modular system which includes the fire suppression module, and a method for installing the modular system on a vessel, configured for containing a flammable material.

In a safety conscious society, the desirability of effective fire suppression systems for use with vessels containing flammable materials is understandable. This desirability extends to many military applications, where the vessels/fuel tanks of various military vehicles can contain large quantities of flammable fuel and are subject to hostile attacks.

One approach which has been utilized to try to minimize the damage caused by vehicle fires is the use of a passive fire suppression system. When used in connection with vessels/fuel tanks, the passive fire protection systems typically rely on "blankets" or "hard panels" to contain or slow the spread of a fire. Both the "blanket" passive fire suppression systems and the "hard panel" fire suppression systems are generally manufactured to specific sizes and constructions based on the particular vessel the systems are to be utilized with.

Because such systems are designed for a specific vessel, adapting the systems for use with other vessel tends to be relatively difficult and expensive, even if only minor changes are needed. This is especially true for applications which require installation in the field.

BRIEF DESCRIPTION OF THE DRAWINGS

Various embodiments of the invention are described herein in by way of example in conjunction with the following figures, wherein like reference characters designate the same or similar elements.

DETAILED DESCRIPTION

It is to be understood that at least some of the figures and descriptions of the invention have been simplified to illustrate elements that are relevant for a clear understanding of the invention, while eliminating, for purposes of clarity, other elements that those of ordinary skill in the art will appreciate may also comprise a portion of the invention. However, because such elements are well known in the art, and because they do not facilitate a better understanding of the invention, a description of such elements is not provided herein.

Figure 1:
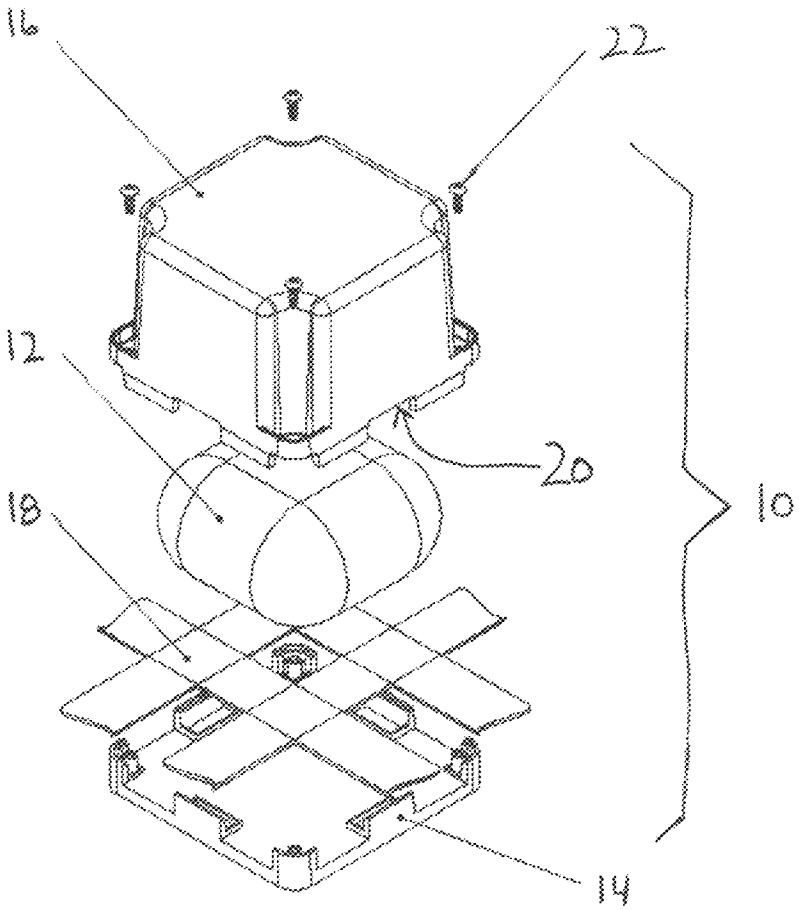
FIG. 1 illustrates an exploded view of various embodiments of a fire suppression module and FIG. 1A illustrates a partial perspective view of a cap member of the fire suppression module of FIG. 1.

FIG. 1 illustrates an exploded view of various embodiments of a fire suppression module 10. The module 10 may be utilized to provide fire suppression to a vessel configured to contain a flammable material. As explained in more detail hereinbelow with respect to FIG. 3, a plurality of such modules 10 may be utilized to provide the fire suppression to such a vessel. For purposes of simplicity, the module 10 will be described hereinafter in the context of its use with a fuel tank of a vehicle. However, it will be appreciated that the module 10 may be utilized in many other applications to provide fire suppression.

As shown in FIG. 1, the fire suppression module 10 includes a fire suppressant 12, a base member 14 and a cap member 16. Also shown in FIG. 1 is a strap 18, which will be described in more detail with respect to FIG. 3. When the fire suppression module 10 is fully assembled, the base member 14 and the cap member 16 are connected to one another to form an enclosure 20, and the fire suppressant 12 is positioned within and surrounded by the enclosure 20. The base member 14 and the cap member 16 may be connected to one another in any suitable manner. For example, according to various embodiments, the base member 14 and the cap member 16 are connected to one another by a plurality of fasteners 22 as shown in FIG. 1. According to other embodiments, the base member 14 and the cap member 16 may be snap-fit together to form a friction connection as described in more detail hereinbelow with respect to FIG. 2, adhered to one another, etc. According to yet other embodiments, the base member 14 and the cap member 16 are integral with each other (formed as a single component).

The fire suppressant 12 may be any suitable type of fire suppressant. For example, according to various embodiments, the fire suppressant 12 is a dry fire retardant powder which includes, for example, one or more of the following: sodium bicarbonate, potassium bicarbonate, potassium chloride, potassium sulfate, monoammonium phosphate, and the like. As shown in FIG. 1, the fire suppressant 12 may be a packaged fire suppressant, where the fire suppressant 12 is packaged into, for example, a sealed plastic bag or similar wrapping to protect the fire suppressant 12 from undesired exposure to moisture. According to other embodiments, the fire suppressant 12 covered by the cap member 16 may be loose or unpackaged as described in more detail hereinbelow with respect to FIG. 2. As different applications may require different amounts of fire suppressant 12, it is understood that the fire suppression module 10 may include any amount of fire suppressant 12 which can be positioned within the enclosure 20 formed by the base member 14 and the cap member 16. Once the fire suppressant 12 is positioned within the enclosure 20, the fire suppressant 12 is protected from incidental contact and external elements such as, for example, ice, stones, road debris, etc.

The base member 14 may be fabricated in any suitable size and shape. For example, according to various embodiments, the base member 14 is a square-shaped base having four sides which are each on the order of approximately four inches in "length". According to other embodiments, the base member 14 may be rectangular-shaped, triangular-shaped, circular-shaped, etc. The base member 14 may also be fabricated from any suitable material. For example, according to various embodiments, the base member 14 is fabricated from an acrylic, an acrylonitrile butadiene styrene (ABS), a polyvinyl chloride (PVC), a polyurethane, a nylon, a composite material, etc. According to various embodiments, as described in more detail hereinbelow with respect to FIG. 2, the base member 14 may be configured to receive and engage protrusions of the cap member 16 to form a snap-fit connection with the cap member 16.

The cap member 16 may be fabricated in any suitable size, shape and color. In general, the footprint of the cap member 16 substantially corresponds to the footprint of the base member 14. Therefore, it will be appreciated that according to various embodiments, the cap member 16 has a square-shaped footprint where each of the four sides have a "length" on the order of approximately four inches. According to other embodiments, the footprint of the cap member 16 may be rectangular-shaped, triangular-shaped, circular-shaped, etc.

The "height" of the cap member 16 may be any suitable height. In general, the "height" of the cap member 16 is sized based on the amount of fire suppressant 12 which will be positioned within the enclosure 20 formed by the base member 14 and the cap member 16. For example, for the embodiments where the cap member 16 has a square-shaped footprint where each of the four sides nave a "length" on the order of approximately four inches, the cap member 16 may have a "height" on the order of approximately three inches if the enclosure 20 formed by the base member 14 and the cap member 16 is to hold approximately one pound of sodium bicarbonate. Of course, it is understood that according to other embodiments, the "height" of the cap member 16 can be more or less than approximately three inches based on the amount of fire suppressant 12 which will be positioned within the enclosure 20.

The cap member 16 may be fabricated from any suitable material. For example, according to various embodiments, the cap member 16 is fabricated from an acrylic, an ABS, a PVC, a polyurethane, a nylon, a composite material, etc. In general, higher tensile modulus materials (e.g., greater than 250,000 PSI) will perform better during destructive events. Additionally, materials having a higher impact resistance will provide better longevity when exposed to external elements.

Figure 1A:
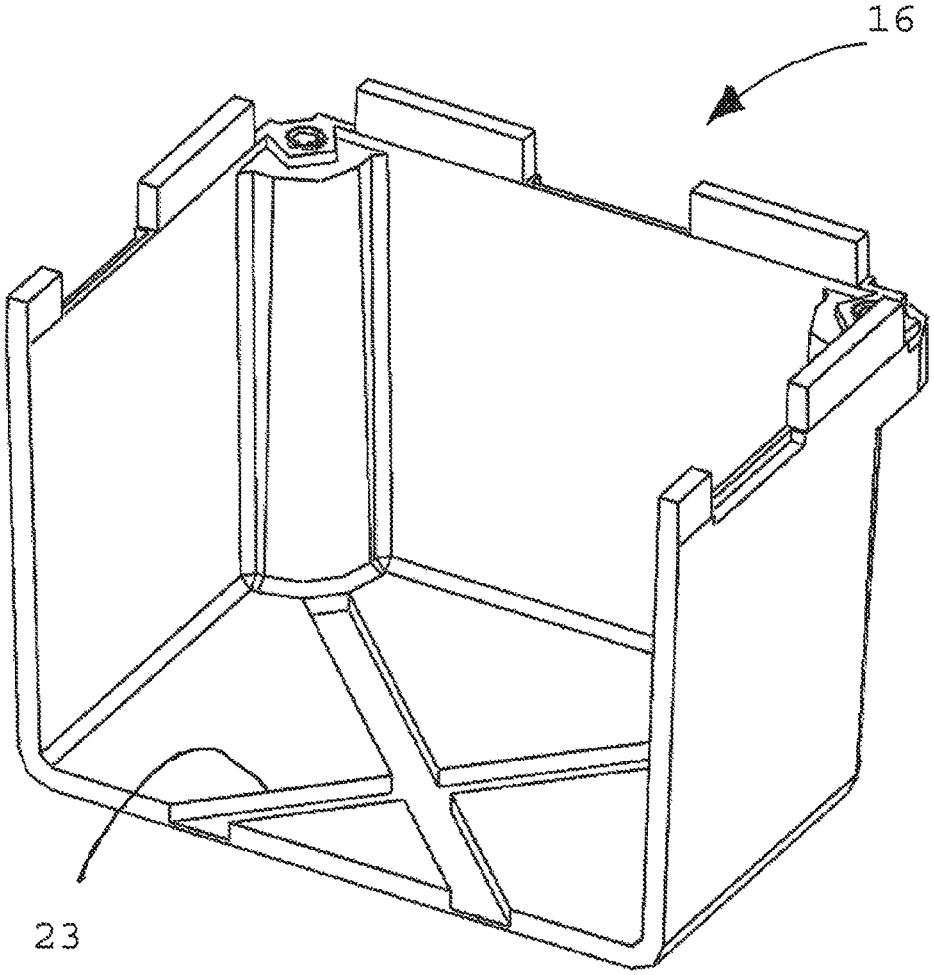

The cap member 16 may also include or incorporate one or more stress risers 23 (not shown in FIG. 1 for purposes of simplicity) which operate to control the location where the cap member 16 breaks or fractures when subjected to a certain stress level. Such stress risers 23 may be embodied in any suitable manner. As different applications (and/or different locations the fire suppression module 10 is installed on a fuel tank) may require different locations for the stress risers 23, it is understood that different embodiments of the fire suppression module 10 may include different stress risers 23. For example, according to various embodiments, the stress risers 23 may be embodied in the form of an "X" pattern on the interior side of the top of the cap member 16 as shown in FIG. 1A. According to other embodiments, the stress risers 23 may be embodied in the form of one or more areas of the cap member 16 where the "thickness" of the cap member 16 has been thinned out in comparison to the other areas of the cap member 16. For example, see the thinned out "X" pattern on the interior side of the top of the cap member 16 as shown in FIG. 1A.

According to various embodiments, the fire suppression module 10 may be a weather resistant fire suppression module 10. Although not shown, for such embodiments, a sealant, a gasket, a system of gaskets, etc. may be positioned between the cap member 16 and the base member 14, between the cap member 16 and any corresponding straps 18, and between the base member 14 and any corresponding straps 18 in order to provide the weather resistance to the fire suppression module 10 and/or prevent or minimize any undesired water or moisture from accumulating in the enclosure 20 formed by the base member 14 and the cap member 16. According to other embodiments, in order to provide the weather resistance to the fire suppression module 10 and/or prevent or minimize any undesired water or moisture from accumulating in the cap member 16, loose or unpackaged fire suppressant 12 may be sealed within the cap member 16 as described in more detail hereinbelow with respect to FIG. 2. Also, although not shown, according to various embodiments, the base member 14 may define an opening (e.g., a drain hole) therethrough and/or the cap member 16 may define an opening (e.g., a vent hole) therethrough, where the respective openings may function to drain any accumulated water and vent any accumulated water moisture from the enclosure 20.

Figure 2:
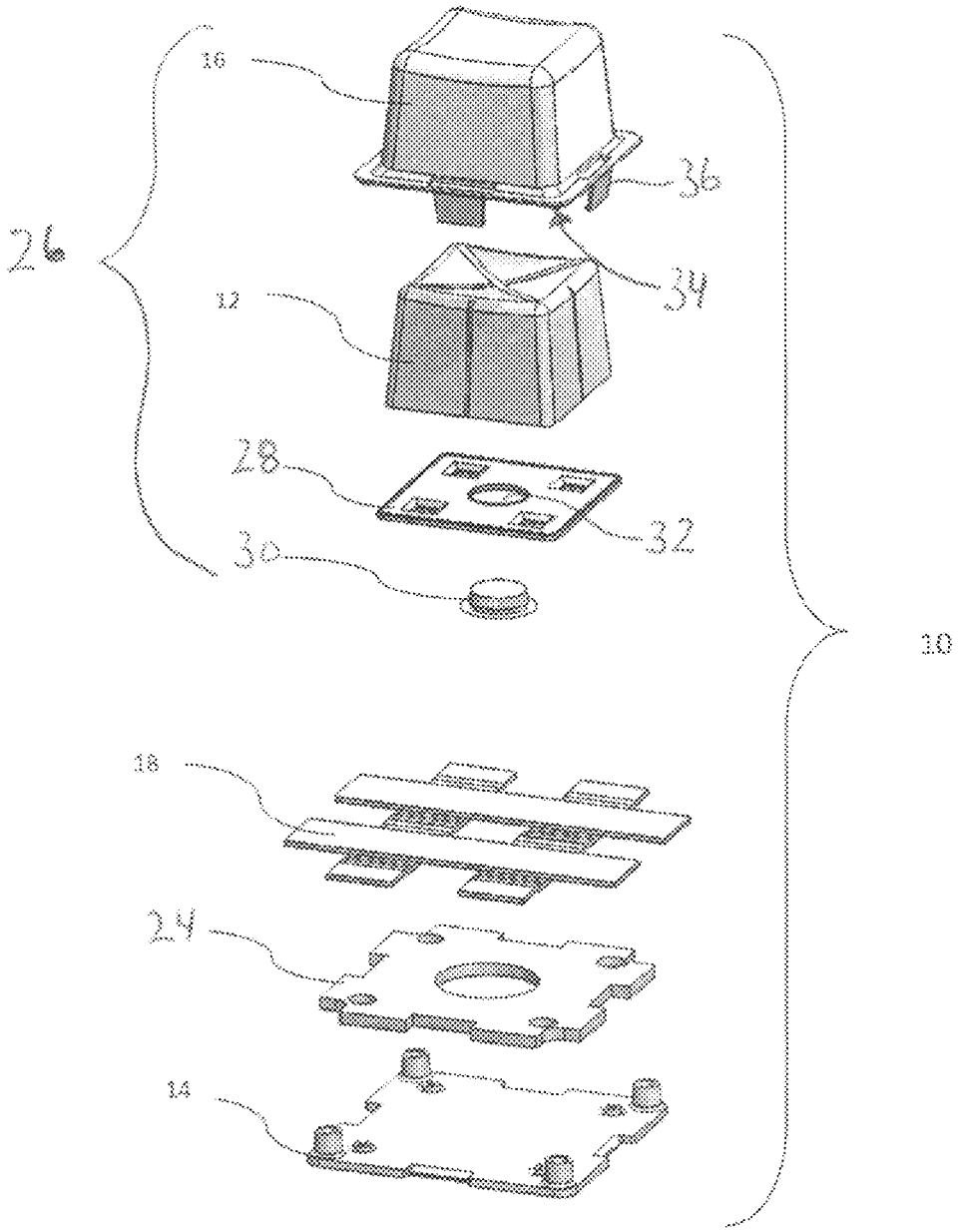
FIG. 2 illustrates an exploded view of other embodiments of a fire suppression module and FIG. 2A illustrates a partial perspective view of a cap member of the fire suppression module of FIG. 2.

FIG. 2 illustrates other embodiments of the fire suppression module 10. For the embodiments shown in FIG. 2, the fire suppression module 10 includes the fire suppressant 12, the base member 14, and the cap member 16, and also includes a compression member 24 and a cap assembly 20 which includes the cap member 16.

The cap assembly 26 includes the cap member 10, a cap floor member 28, and a plug member 30. The cap floor member 28 defines an opening 32 therethrough, and is connected to the cap member 16 to form a sub-enclosure 34. The cap floor member 28 may be connected to the cap member 16 in any suitable manner. For example, according to various embodiments, the cap floor member 28 may be welded, adhered or mechanically sealed to the cap member 16. The cap floor member 28 may be fabricated from any suitable material. For example, according to various embodiments, the cap floor member 28 is fabricated from an acrylic, an ABS, a PVC, a polyurethane, a nylon, a composite material, etc. According to various embodiments, the cap member 16 and the cap floor member 28 are integral with each other (formed as a single component).

Figure 2A:
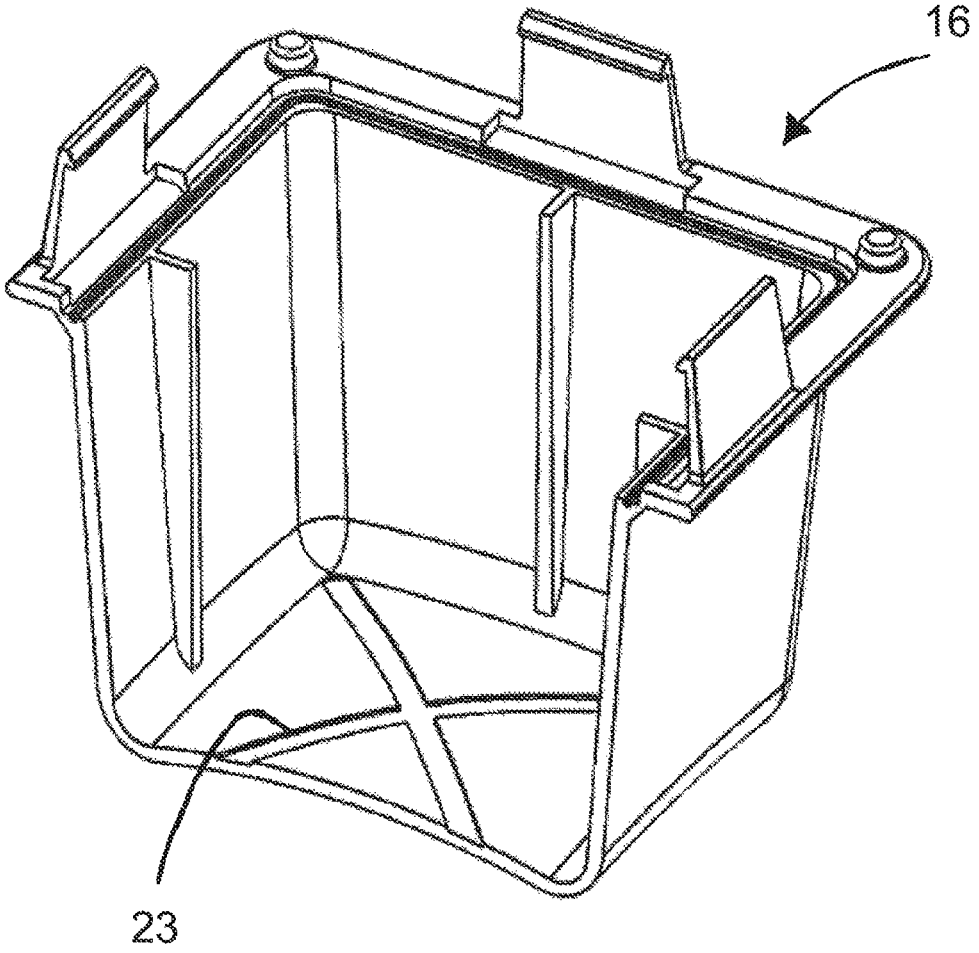

For the embodiments shown in FIG. 2, the fire suppressant 12, which is initially in a loose or unpackaged form, is delivered through the opening 32 of the cap floor member 28 into the sub-enclosure 34. Once the appropriate amount of fire suppressant has been delivered into the sub-enclosure 34, the plug member 30 can be inserted into the opening 32 to seal the sub-enclosure 34 and create a moisture barrier to keep the enclosed fire suppressant 12 from undesired exposure to moisture. The fire suppressant 12 is shown in FIG. 2 in its "packed" form (as packed into the sub-enclosure 34) and is shown as including a raised "X" pattern on its top surface. The raised "X" pattern corresponds to the thinned out "X" pattern associated with the stress riser 23 on the interior side of the top of the cap member 16 as shown in FIG. 2A. The plug member 30 may be fabricated from any suitable material. For example, according to various embodiments, the cap floor member 28 is fabricated from an acrylic, an ABS, a PVC a polyurethane, a nylon, a composite material etc.

For the embodiments shown in FIG. 2, the cap member 16 includes protrusions 36 which engage into and lock on base member 14, thereby forming a snap-fit/friction connection between the cap assembly 26 and the base member 14 and forming the enclosure 20. When the cap assembly 26 is connected to the base member 14, the compression member 24 is positioned within and surrounded by the enclosure 20. The compression member 24 maintains the connection between the cap assembly 26 and the base member 14. The compression member 24 may be fabricated from any suitable material. For example, according to various embodiments, the compression member 24 is fabricated from an elastomeric material such as a urethane, a rubber, a thermoplastic and the like.

According to other embodiments of the fire suppression module 10 of FIG. 2, the cap floor member 28 does not define the opening 32 and the plug member 30 is eliminated. For such embodiments, the cap floor member 28 may be embodied as a foil, film or the like, and may be welded, adhered or mechanically sealed to the cap member 16 to form the sub-enclosure 34 after the fire suppressant 12 has been placed into the interior volume of the cap member 16 which forms part of the sub-enclosure 34.

According to yet other embodiments of the fire suppression module 10 of FIG. 2, the cap floor member 28 provides the functionality of the base member 14 and the base member 14 is eliminated. Alternatively, according to yet other embodiments of the fire suppression module 10 of FIG. 2, the base member 14 is configured to provide the functionality of the cap floor member 28 and the cap floor member 28 is eliminated.

Figure 3:
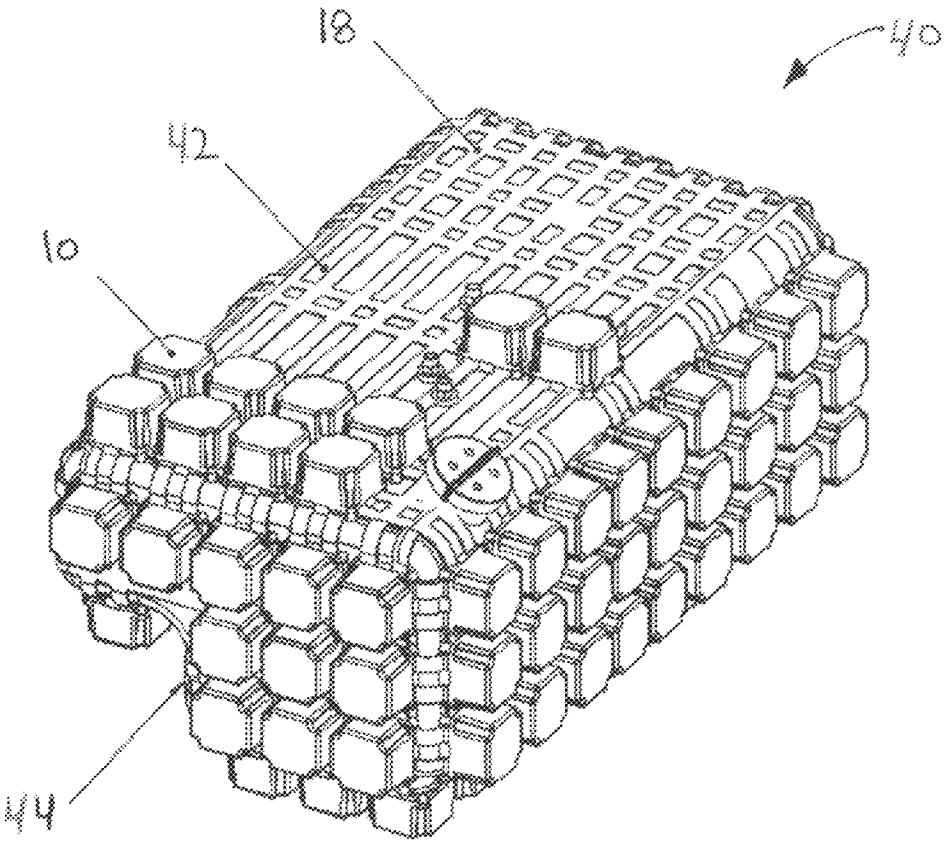
FIG. 3 illustrates various embodiments of a fire suppression system which includes the fire suppression module of FIG. 1.

FIG. 3 illustrates various embodiments of a fire suppression system 40. The system 40 may be utilized to provide fire suppression to a vessel 42 configured to contain a flammable material. For purposes of simplicity, the system 40 will be described hereinafter in the context of its use with a fuel tank 42 of a vehicle. However, it will be appreciated that the system 40 may be utilized in many other applications to provide fire suppression.

As shown in FIG. 3, the system 40 includes a plurality of the fire suppression modules 10 and a plurality of the straps 18, and may also include a plurality of attachment members 44. For purposes of simplicity, the system 40 will be described in the context of its incorporation of the fire suppression modules 10 of FIG. 1. However, it will be appreciated that the system 40 may also incorporate the fire suppression modules 10 of FIG. 2. Although each of the fire suppression modules 10 are shown as being the same in FIG. 3, it will be appreciated that according to various embodiments, the system 40 may include two or more different sizes and/or shapes of fire suppression modules 10 to meet the anticipated fire suppression needs for a particular fuel tank 42. For example, the system 40 may include fire suppression modules 10 which vary in size, shape and/or the amount of fire suppressant 12 positioned within the enclosures 20 formed by the respective base members 14 and cap members 16.

The straps 18 are flexible straps and may be fabricated from any satiable material. For example, according to various embodiments, the straps 18 are fabricated from a metal, a plastic, a rubber, a composite material, etc. The straps 18 are arranged to form a pattern or matrix over the fuel tank 42. According to various embodiments, the respective straps 18 may be sewn, adhered, bonded, welded, etc. to one another to create a strapping or webbing which is positioned, over the fuel tank 42. For example, any overlap formed by a given strap 18 and any other intersecting strap 18 may be sewn together, adhered together, bonded together, welded together, etc. According to various embodiments, at least some of the straps 18 have two loose ends which are not sewn to, adhered to, bonded to, welded to, etc. another strap 18. According to other embodiments, at least some of the straps 18 have one loose end which is not sewn to, adhered to, bonded to, welded to, etc. another strap 18. In general, the pattern or matrix formed by the straps 18 allows for a desired placement of the fire suppression modules 10 over the fuel tank 42. Although the pattern shown in FIG. 3 is substantially rectangular, it will be appreciated that according to other embodiments, the pattern may be polar, a combination of polar and rectangular, a random array, etc.

According to various embodiments, when a given fire suppression module 10 is installed over the fuel tank 42, portions of a plurality of the individual straps 18 (e.g., portions of four straps 18) are positioned over the base member 14 of the fire suppression module 10, under the associated fire suppressant 12, and within the enclosure 20 formed by the base member 14 and the cap member 16 of the given fire suppression module 10 (See FIG. 1). According to other embodiments, instead of utilizing a corresponding base member 14 with a corresponding cap member 16, the system 40 may utilize a common base member 14 with a plurality of cap members 16 (e.g., four cap members 16). For example, the system 40 may include a common base member 14 configured to be connected to a plurality of individual cap members 16 to form a plurality of individual enclosures 20, with an individual fire suppressant 12 positioned within each individual enclosure 20. For such embodiment, it will be appreciated that the use of the common base member 14 can allow for a reduction in the number of straps 18 and/or attachment members 44 utilized. According to various embodiments, the system 40 may utilize a common enclosure member 16 with a common base member 14 to form a plurality of individual enclosures 20 (e.g., four individual enclosures 20).

As shown in FIG. 3, some areas of the fuel tank 42 may be covered by the fire suppression modules 10 whereas other areas of the fuel tank 42 may not be covered by the fire suppression modules 10. Although not shown for purposes of simplicity, it will be appreciated that the various fire suppression modules 10 used to covet the fuel tank 42 may be fabricated in different colors (e.g., four different colors), sizes and shapes. For embodiments of the system 40 which utilize different colors of fire suppression modules 10, the different colors provide a form of two-dimensional camouflage for the covered fuel tank 42. For embodiments where the system 40 also utilizes fire suppression modules 10 having different sizes (e.g., "heights"), the different sizes provide a form of three-dimensional camouflage for the covered fuel tank 42. Although not shown, it will be appreciated that some areas of the fuel tank 42 may be covered by one or more fire suppression modules 10 having a first size, shape and/or color, another area of the fuel tank 42 may be covered by one or more fire suppression modules 10 having a second size, shape and/or color, yet another area of the fuel tank 42 may be covered by one or more fire suppression modules 10 having a third size, shape and/or color, etc. According to various embodiments, larger fire suppression modules 10 which enclose a larger quantity of fire suppressant 12 may be utilized over areas of the fuel tank 42 which are more subject to and/or closer to an anticipated destructive event (e.g., a blast, impact by a projectile, etc.), and smaller fire suppression modules 10 which enclose a smaller quantity of fire suppressant 12 may be utilized over areas of the fuel tank 42 which are less subject to and/or farther away from an anticipated destructive event.

It is anticipated that the system 40 may be utilized for vehicles such as amphibious vehicles. For such applications, it will be appreciated that when the vehicle is in the water, the fire suppression modules 10 can create a buoyant effect, causing an upward force (exerted by the water) that opposes the weight of the vehicle. For instances where a significant number of the fire suppression modules 10 are utilized, the buoyant effect may increase the vehicle's ability to float in the water.

For embodiments where at least some of the straps 18 have loose ends, the system 40 includes a plurality of attachment members 44. The attachment members 44 may be any suitable type of attachment members 44 and are utilized with the loose ends of the straps 18 to "close up" the mesh of straps 18 covering the fuel tank 42. For example, according to various embodiments, where a given strap 18 has two loose ends, a given attachment member 44 includes two double D-rings (or a similar arrangement), where each double D-ring is configured to receive a respective loose end of the given strap 18. For a first loose end of the given strap 18, the first loose end may be passed through a first set of the double D-rings in a first direction (first through a first D-ring then through a second D-ring), then after the D-rings are separated from one another, the loose end of the given strap 18 may be passed over the top of the second D-ring and back through the first D-ring in a direction opposite the first direction, then pulled to a desired tightness. Similarly, for a second loose end of the given strap 18, the second loose end may be passed through a second set of the double D-rings in a first direction (first through a first D-ring then through a second D-ring), then after the D-rings are separated from one another, the loose end of the given strap 18 may be passed over the top of the second D-ring and back through the first D-ring in a direction opposite the first direction, then pulled to a desired tightness.

According to other embodiments, where a given strap 18 has two loose ends, a given attachment member 44 may include a double D-ring (or similar arrangement) connected to one loose end of the given strap 18 as described above and a hook member or similar member connected to the other loose end of the given strap 18. For such embodiments, the hook member may be utilized to "close up" the mesh of straps 18 covering the fuel tank 42 by hooking one or more of the straps 18 of the mesh of straps 18 (e.g., by pulling the hook to place the hook over an intersection of straps 18, into an open area of the mesh, and over an opposite side of the intersection). The hook member may be connected to the other loose end of the given strap 18 in any suitable manner. For example, according to various embodiments, the other loose end of the given strap 18 may be passed through an opening in the hook member in a first direction, be looped around the opening and taken back in a second direction, and then be fastened to, sewn to, bonded to, welded to, etc. a portion of the given strap 18.

According to various embodiments, only one end of a given strap 18 is a loose end. For such embodiments, a hook member or similar member may be connected to the loose end of the given strap 18, and the hook member may be utilized to "close up" the mesh of straps 18 covering the fuel tank 42 as described hereinabove.

According to various embodiments, in addition to being connected to at least one end of a given snag 18, a given attachment member 44 may also be connected to the fuel tank 42. For such embodiments, the given attachment member 44 may be connected to the fuel tank 42 in any suitable manner. For example, the attachment member 44 may be hooked onto the fuel tank 42, fastened to the fuel tank 42, bonded to the fuel tank 42, welded to the fuel tank 42, etc.

According to various embodiments, the system 40 may include connectors (not shown for purposes of simplicity) in lieu of at least some of, if not all of, the straps 18 and attachment members 44. For such embodiments, the connectors may be utilized to connect adjacent fire suppression modules 10 to one another to create a pattern or matrix of fire suppression modules 10 over the feel tank 42. Such connectors may be embodied as any suitable type of connector. For example, according to various embodiments, the connectors may be pre-molded or fabricated connectors, tensioner, buckle, connector module-to-module connectors, D-loops attached to each fire suppression module 10, etc. Such connectors may be connected to the respective fire suppression modules 10 in any suitable manner. For example, such connectors may be fastened, adhered, bonded, welded, etc. to the respective fire suppression modules 10.

Figure 4A:
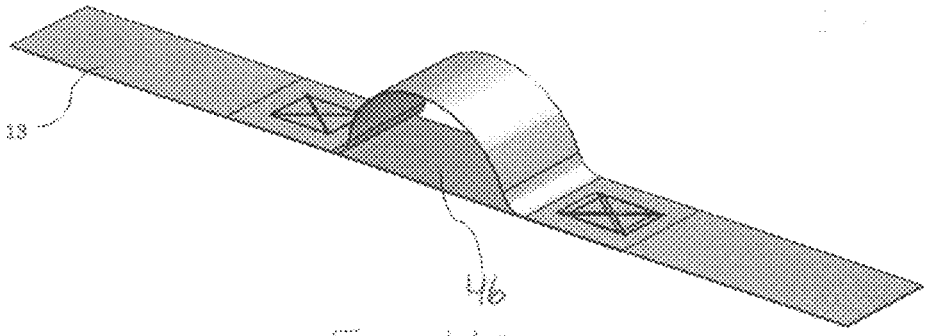
FIGS. 4A and 4B illustrate various embodiments of strap tension compensators for the fire suppression system of FIG. 3.
Figure 4B:
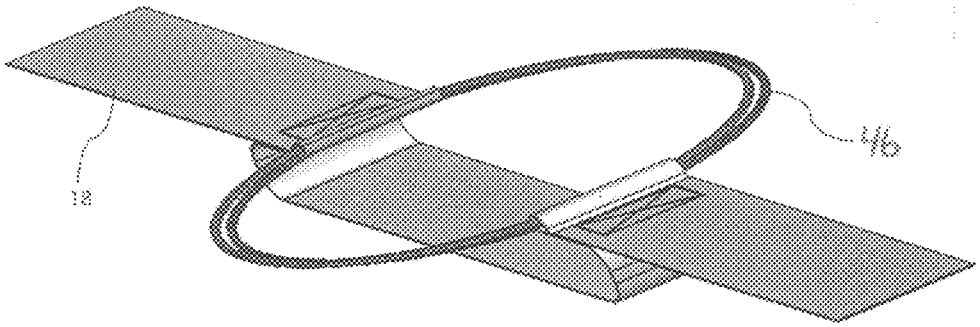

According to various embodiments, the system 40 may also include one or more strap tensioner compensators 46. Various embodiments of the strap tensioner compensators 46 are shown in FIGS. 4A and 4B. As the straps 18 are used over time and are exposed to variations in the environmental temperature and humidity, it is possible that the overall length of the straps 18 can be affected. The strap tensioner compensators 46 operate to maintain the appropriate tension, if needed, on the straps 18 covering the fuel tank 42. According to various embodiments, the strap tensioner compensator 46 is fabricated from an elastic material such as, for example, a rubber material, a plastic material, etc. and may be of any suitable size and configuration. For example, as shown in FIG. 4A, the strap tensioner compensator 46 is connected to the strap 18 and is shown as being in the form of a thin strap (e.g., 1/16" to 1/4" thick) which passes under the "horseshoe-shaped" portion of the strap 18 and extends to the left and right of the "horseshoe-shaped" portion. Although the strap tensioner compensator 46 is shown in FIG. 4A as being sewn to the strap 18, it will be appreciated that the strap tensioner compensator 46 may be connected to the strap 18 in any suitable manner. In FIG. 4B, the strap tensioner compensators 46 is shown as being in the form of two rings which pass through loops formed by the straps 18. It will be appreciated that according to other embodiments, the strap tension compensators 46 may be in the form of springs, hardware similar to turn-buckles, etc. to achieve the strap tension compensation.

In view of the above, it will be appreciated that the system 40 is essentially a modular system, utilizing one or more embodiments of individual fire suppression modules 10 to easily construct a customized fire suppression system for any size and shape of fuel tank 42. The flexibility afforded by the modularity of the system 40 makes the system 40 especially suitable for field applications where the fuel tank 42 is already installed on a vehicle.

Figure 5:
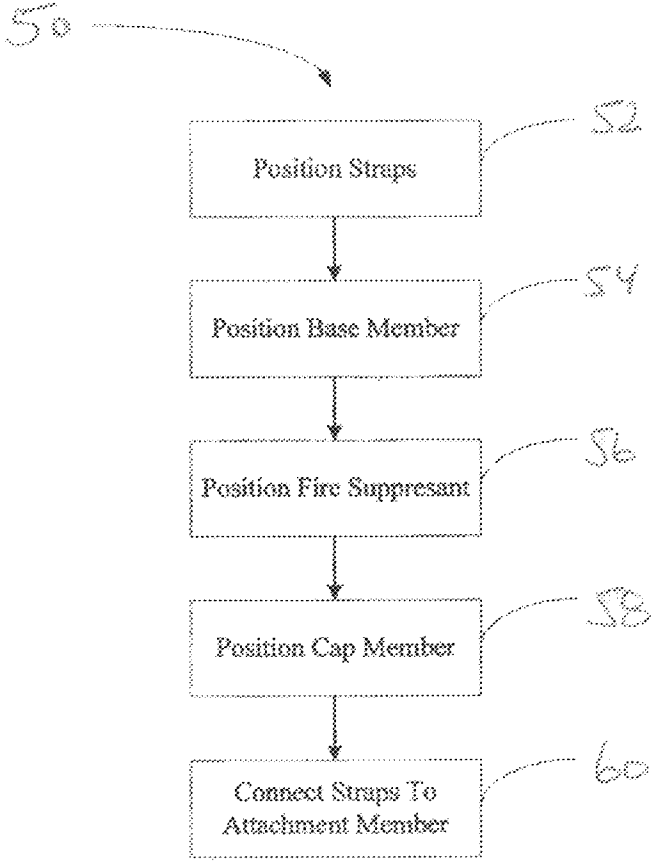
FIG. 5 illustrates various embodiments of a method for installing the fire suppression system of FIG. 3.

FIG. 5 illustrates various embodiments of a method 50 for installing the fire suppression system 40 on a fuel tank 42. The method 50 may be implemented "in the shop" on a fuel tank 42 which is removed from a vehicle or still installed on the vehicle, as well as "in the field" on a fuel tank 42 which is still installed on a vehicle. Prior to the start of the process, the straps 18 may be sewn together, adhered together, bonded together, welded together, etc. to form a strapping or webbing of a given pattern or matrix. Additionally, the attachment members 44 may be connected to at least some of the straps 18. For purposes of simplicity, the method 50 will be described in the context of the fire suppression system 40 including the fire suppression modules 10 of FIG. 1. However, it will be appreciated that other embodiments of the method 50 may be utilized for installing the fire suppression system 40 which includes the fire suppression modules 10 of FIG. 2.

The process starts at block 52, where the straps 18 are positioned over the fuel tank 42. According to various embodiments, the strapping or webbing may be pulled over the fuel tank 42 much like in the manner a sock is pulled over a foot.

From block 52, the process advances to block 54, where a base member 14 (or at least a portion of a fire suppression module 10) is positioned under the strapping or webbing at a location over the fuel tank 42. According to various embodiments, the strapping or webbing is flexible enough to allow the strapping or webbing to be pulled away from the fuel tank 42 (or adjacent straps apart from one another) a sufficient distance to allow the base member 14 to be positioned under the strapping or webbing and over the fuel tank 42. The base member 14 may correspond to an individual cap member 16, or may be a common base member 14 which corresponds to a plurality of cap members 16 or to a common cap member 16. For embodiments where the method 50 is utilized for installing the fire suppression system 40 which includes the fire suppression modules 10 of FIG. 2, it will be appreciated that the compression member 24 could also be positioned under the strapping or webbing at this step.

From block 54, the process advances to block 56, where an individual package of fire suppressant 12 is positioned over the portions of the strapping or webbing which is positioned over the base member 14. For embodiments where the base member 14 is a common base 14 configured to be connected to a plurality of cap members 16, a plurality of individual packages of fire suppressant 12 are positioned over the base member 14. For embodiments where the method 50 is utilized for installing the fire suppression system 40 which includes the fire suppression modules 10 of FIG. 2, it will be appreciated that this step could be eliminated because the fire suppressant 12, in its loose or unpackaged form, is sealed within the sub-enclosure 34 of the cap assembly 25.

From block 56, the process advances to block 58, where a cap member 16 is positioned over an individual package of fire suppressant 12 and is connected at a corresponding base member 14. For embodiments where the base member 14 is a common base member 14 configured to be connected to a plurality of cap members 16, the respective cap members 16 are positioned over the corresponding individual packages of fire suppressant 12 and are connected to the common base member 14. For embodiments where the base member 14 is a common base member 14 configured to be connected to a common cap member 16, the common cap member 16 is positioned over the corresponding individual packages of fire suppressant 12 and is connected to the common base member 14. Each cap member 16 may be connected to the base member 14 by fasteners 20, by snap-fit, by an adhesive, etc. For embodiments where the method 50 is utilized for installing the fire suppression system 40 which includes the fire suppression modules 10 of FIG. 2, it will be appreciated that the cap assembly 25, which would have been assembled previous to this step, would be positioned over and connected to the base member 14 at this step. The process described at blocks 54-58 may be repeated any number of times until all of the fire suppression modules 10 have been installed over the fuel tank 42.

Once all of the fire suppression modules 10 have been installed, the process advances from block 58 to block 60, where the respective attachment members 44 are connected to one or more of the following to "close up" the mesh of straps 18 covering the fuel tank 42 and complete the installation of the system 40: (1) any remaining loose ends of the straps 18; (2) one or more of the straps 18 is of the mesh of straps 18, and/or (3) the fuel tank 42. According to various embodiments, the attachment members 44 may be connected as set forth above prior to the installation of all of the fire suppression modules 10. For example, the attachment members 44 may be connected as set forth above alter a sufficient number of the fire suppression modules 10 have been installed.

Nothing in the above description is meant to limit the invention to any specific materials, geometry, or orientation of elements. Many part/orientation substitutions are contemplated within the scope of the invention and will be apparent to those skilled in the art. The embodiments described herein were presented by way of example only and should not be used to limit the scope of the invention.

Although the invention has been described in terms of particular embodiments in this application, one of ordinary skill in the art, in light of the teachings herein, can generate additional embodiments and modifications without departing from the spirit of, or exceeding the scope of, the described invention. For example, instead positioning one base member 14 then assembling the fire suppression module 10 associated with that base member 14 before positioning another base member 14, a plurality of base members 14 may be positioned before assembling the respective fire suppression modules 10 associated with the plurality of base members 14. Another example would be moving the "positioning of the straps 18" step described at block 42 to occur after the "positioning the cap member 16" step described at block 48. Yet another example would be fabricating the cap member 16 (or the can assembly 26) and the base member 14 as a single component. Accordingly, it is understood that the drawings and the descriptions herein are proffered only to facilitate comprehension of the invention and should not be construed to limit the scope thereof.

What is claimed is:

1. A fire suppression system, comprising:

a plurality of straps, wherein at least one of the plurality of straps is connected to several other of the plurality of straps;

a plurality of attachment members, wherein each respective attachment member is connected to a different strap; and a plurality of fire suppression modules, wherein one or more of the fire suppression modules are connected to at least one of the plurality of straps, and wherein at least two of the fire suppressant modules respectively comprise:

a base member comprising at least one side portion which defines at least one receptacle;

a cap member connected to the base member, wherein the cap member defines at least one stress riser and comprises at least one side portion which defines at least one protrusion configured to be received by the at least one receptacle, and wherein the base member and the cap member cooperate to form an enclosure; and a fire suppressant, wherein the fire suppressant comprises a fire retardant powder and is positioned within the enclosure.

2. The fire suppression system of claim 1, wherein the at least one protrusion is configured to engage with the base member.

3. The fire suppression system of claim 1, further comprising a cap assembly, the cap assembly comprising:

the cap member;

a cap floor member connected to the cap member.

4. The fire suppression system of claim 3, wherein the cap floor member is integral with the cap member.

5. The fire suppression system of claim 3, wherein the cap member and the cap floor member cooperate to form a sub-enclosure, and wherein the fire suppressant is positioned within the sub-enclosure.

6. The fire suppression system of claim 3, wherein:

the cap floor member defines an opening therethrough; and the cap assembly further comprises a plug member positioned in the opening.

7. The fire suppression system of claim 3, further comprising a compression member positioned between the cap assembly and the base member.

8. The fire suppression system of claim 1, further comprising a strap tension compensator connected to at least one of the plurality of straps.

* * * * *